US011825913B2

(12) United States Patent
Beers et al.

(10) Patent No.: US 11,825,913 B2
(45) **Date of Patent: *Nov. 28, 2023**

(54) POSITION SENSING ASSEMBLY FOR A TENSIONING SYSTEM

(71) Applicant: NIKE, Inc., Beaverton, OR (US)

(72) Inventors: Tiffany A. Beers, Portland, OR (US); Andrew A. Owings, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 102 days.

This patent is subject to a terminal disclaimer.

(21) Appl. No.: 17/473,592

(22) Filed: Sep. 13, 2021

(65) Prior Publication Data

US 2021/0401122 A1 Dec. 30, 2021

Related U.S. Application Data

(63) Continuation of application No. 16/274,458, filed on Feb. 13, 2019, now Pat. No. 11,129,446, which is a continuation of application No. 15/070,995, filed on Mar. 15, 2016, now Pat. No. 10,238,180.

(51) Int. Cl.

| | |
|---|---|
| ***A43B 3/44*** | (2022.01) |
| ***A43C 11/16*** | (2006.01) |
| ***A43B 11/00*** | (2006.01) |
| ***A43B 3/34*** | (2022.01) |
| ***A43C 11/14*** | (2006.01) |

(52) U.S. Cl.

CPC ..... *A43C 11/165* (2013.01); *A43B 3/34* (2022.01); *A43B 3/44* (2022.01); *A43B 11/00* (2013.01); *A43C 11/14* (2013.01); *A43C 11/16* (2013.01)

(58) Field of Classification Search

CPC ..... A43C 11/16; A43C 11/165; A43B 3/0005

See application file for complete search history.

(56) References Cited

U.S. PATENT DOCUMENTS

| | | | |
|---|---|---|---|
| 4,379,615 | A | 4/1983 | Toda et al. |
| 4,687,359 | A | 8/1987 | Barrus et al. |
| 5,839,210 | A | 11/1998 | Bernier et al. |

(Continued)

FOREIGN PATENT DOCUMENTS

| | | | |
|---|---|---|---|
| CN | 1451147 | A | 10/2003 |
| CN | 1726361 | A | 1/2006 |

(Continued)

OTHER PUBLICATIONS

"Korean Application Serial No. 10-2018-7029259, Response Filed Nov. 9, 2021 to Notice of Preliminary Rejection dated Jul. 29, 2021", w English claims, 71 pgs.

(Continued)

*Primary Examiner* — Sharon M Prange

(74) *Attorney, Agent, or Firm* — Schwegman, Lundberg & Woessner, P.A.

(57) ABSTRACT

A position sensing assembly for a tensioning system designed to provide tension to a lace, cord, or other type of strand is disclosed. The tensioning system includes a reel member configured to rotate about a central axis and the position sensing assembly. The position sensing assembly includes a shaft, an indicator tab, and an optical sensing unit. The position sensing assembly assists in controlling the degree to which the strand is tightened and loosened. The position sensing assembly prevents tightening of the strand when the strand is meant to be loosened.

20 Claims, 11 Drawing Sheets

(56) References Cited

U.S. PATENT DOCUMENTS

| | | | |
|---|---|---|---|
| 6,694,861 | B2 | 2/2004 | Glasson |
| 7,197,974 | B2 | 4/2007 | Glasson |
| 7,395,614 | B1 | 7/2008 | Bailey, Sr. et al. |
| 7,752,774 | B2 | 7/2010 | Ussher |
| 8,146,417 | B2 | 4/2012 | Glasson et al. |
| 8,205,877 | B2 | 6/2012 | Spinetti |
| 8,935,860 | B2 | 1/2015 | Torres |
| 10,238,180 | B2 | 3/2019 | Beers et al. |
| 11,129,446 | B2 | 9/2021 | Beers et al. |
| 2003/0005870 | A1 | 1/2003 | Matsuzawa et al. |
| 2003/0150135 | A1 | 8/2003 | Liu |
| 2003/0204938 | A1 | 11/2003 | Hammerslag |
| 2005/0160864 | A1 | 7/2005 | Glasson |
| 2007/0261270 | A1 | 11/2007 | Nadel et al. |
| 2009/0272007 | A1 | 11/2009 | Beers et al. |
| 2011/0112412 | A1 | 5/2011 | Sano et al. |
| 2012/0273516 | A1 | 11/2012 | Cooke et al. |
| 2013/0345612 | A1 | 12/2013 | Bannister et al. |
| 2014/0068838 | A1 | 3/2014 | Beers et al. |
| 2014/0070042 | A1 | 3/2014 | Beers et al. |
| 2014/0082963 | A1 | 3/2014 | Beers |
| 2014/0094728 | A1 | 4/2014 | Soderberg et al. |
| 2014/0257156 | A1 | 9/2014 | Capra et al. |
| 2015/0073322 | A1 | 3/2015 | Cohen |
| 2015/0237962 | A1 | 8/2015 | Soderberg et al. |
| 2016/0345681 | A1 | 12/2016 | Pheil et al. |
| 2017/0265576 | A1 | 9/2017 | Beers et al. |
| 2019/0174870 | A1 | 6/2019 | Beers et al. |

FOREIGN PATENT DOCUMENTS

| | | | |
|---|---|---|---|
| CN | 102132983 | A | 7/2011 |
| CN | 102191590 | A | 9/2011 |
| CN | 103476288 | A | 12/2013 |
| CN | 103896104 | A | 7/2014 |
| CN | 104582519 | A | 4/2015 |
| CN | 104822284 | A | 8/2015 |
| CN | 108778031 | A | 11/2018 |
| CN | 108778031 | B | 8/2020 |
| CN | 111938277 | A | 11/2020 |
| CN | 111938277 | | 2/2022 |
| EP | 3429404 | B1 | 12/2020 |
| JP | S50146081 | U | 12/1975 |
| JP | H1173812 | A | 3/1999 |
| JP | 2019512316 | A | 5/2019 |
| JP | 2022160485 | | 10/2022 |
| KR | 102409194 | | 6/2022 |
| KR | 20220084431 | | 6/2022 |
| WO | WO-2013191933 | A2 | 12/2013 |
| WO | WO-2014036371 | A1 | 3/2014 |
| WO | WO-2014074645 | A3 | 7/2014 |
| WO | WO-2017160708 | A2 | 9/2017 |

OTHER PUBLICATIONS

"Japanese Application Serial No. 2018-548667, Final Notification of Reasons for Refusal dated Nov. 30, 2021", w English translation, 4 pgs.
"Chinese Application Serial No. 202010766780.6, Response filed Sep. 27, 2021 to Office Action dated May 28, 2021", With English claims, 39 pgs.
"European Application Serial No. 20209406.6, Response filed Oct. 5, 2021 to Extended European Search Report dated Feb. 19, 2021", 11 pgs.
"U.S. Appl. No. 15/070,995, Non Final Office Action dated Mar. 28, 2018", 13 pgs.
"U.S. Appl. No. 15/070,995, Notice of Allowability dated Dec. 12, 2018", 2 pgs.
"U.S. Appl. No. 15/070,995, Notice of Allowance dated Nov. 7, 2018", 5 pgs.
"U.S. Appl. No. 15/070,995, Response filed Jun. 28, 2018 to Non Final Office Action dated Mar. 28, 2018", 10 pgs.
"U.S. Appl. No. 16/274,458, Non Final Office Action dated Dec. 10, 2020", 11 pgs.
"U.S. Appl. No. 16/274,458, Notice of Allowance dated May 27, 2021", 8 pgs.
"U.S. Appl. No. 16/274,458, Response filed Mar. 10, 2021 to Non Final Office Action dated Dec. 10, 2020", 9 pgs.
"U.S. Appl. No. 16/274,458, Response filed Oct. 20, 2020 to Restriction Requirement dated Jul. 21, 2020", 10 pgs.
"U.S. Appl. No. 16/274,458, Restriction Requirement dated Jul. 21, 2020", 7 pgs.
"U.S. Appl. No. 16/274,458, Supplemental Notice of Allowability dated Jun. 24, 2021", 2 pgs.
"U.S. Appl. No. 16/274,458, Supplemental Notice of Allowability dated Sep. 1, 2021", 2 pgs.
"Chinese Application Serial No. 201780017746.5, Office Action dated Oct. 11, 2019", w/ English Translation, 12 pgs.
"Chinese Application Serial No. 201780017746.5, Response filed Apr. 27, 2020 to Office Action dated Oct. 11, 2019", w/ English Claims, 42 pgs.
"Chinese Application Serial No. 201780017746.5, Voluntary Amendment filed Jul. 4, 2019", w/ English claims, 26 pgs.
"Chinese Application Serial No. 202010766780.6, Office Action dated May 28, 2021", w/ English Translation, 22 pgs.
"European Application Serial No. 17767258.1, Extended European Search Report dated Oct. 9, 2019", 7 pgs.
"European Application Serial No. 17767258.1, Response filed Mar. 25, 2020 to Extended European Search Report dated Oct. 9, 2019", 16 pgs.
"European Application Serial No. 17767258.1, Response filed Apr. 26, 2019 to Communication Pursuant to Rules 161 and 162 dated Oct. 26, 2018", 18 pgs.
"European Application Serial No. 20209406.6, Extended European Search Report dated Feb. 19, 2021", 11 pgs.
"International Application Serial No. PCT/US2017/022081, International Preliminary Report on Patentability dated Sep. 27, 2018", 8 pgs.
"International Application Serial No. PCT/US2017/022081, International Search Report dated Jun. 16, 2017", 5 pgs.
"International Application Serial No. PCT/US2017/022081, Written Opinion dated Jun. 16, 2017", 6 pgs.
"Japanese Application Serial No. 2018-548667, Notification of Reasons for Refusal dated Mar. 30, 2021", w/ machine English translation, 7 pgs.
"Japanese Application Serial No. 2018-548667, Response filed Jun. 24, 2021 to Notification of Reasons for Refusal dated Mar. 30, 2021", w/ English claims, 11 pgs.
"Korean Application Serial No. 10-2018-7029259, Notice of Preliminary Rejection dated Jul. 29, 2021", w/ English Translation, 6 pgs.
"Japanese Application Serial No. 2018-548667, Response filed Feb. 9, 2022 to Final Notification of Reasons for Refusal dated Nov. 30, 2021", w English claims, 11 pgs.
"Japanese Application Serial No. 2022-115571, Voluntary Amendment filed Aug. 17, 2022", w English claims, 10 pgs.
"Korean Application Serial No. 10-2022-7019669, Notice of Preliminary Rejection dated Feb. 20, 2023", w English Translation, 5 pgs.
"Korean Application Serial No. 10-2022-7019669, Response filed Apr. 3, 2023 to Notice of Preliminary Rejection dated Feb. 20, 2023", w English claims, 19 pgs.

POSITION SENSING ASSEMBLY FOR A TENSIONING SYSTEM

RELATED APPLICATIONS

This application is a continuation of U.S. patent application Ser. No. 16/274,458, filed Feb. 13, 2019, which application is a continuation of U.S. patent application Ser. No. 15/070,995, filed Mar. 15, 2016, issued on Mar. 26, 2019 as U.S. Pat. No. 10,238,180, the contents of both which are incorporated herein by reference in their entireties.

BACKGROUND

The present embodiments relate generally to position sensing assembly. More particularly, the present embodiments relate to articles of footwear including tensioning systems with position sensing assemblies.

Articles of footwear generally include two primary elements: an upper and a sole structure. The upper is often formed from a plurality of material elements (e.g., textiles, polymer sheet layers, foam layers, leather, synthetic leather) that are stitched or adhesively bonded together to form a void on the interior of the footwear for comfortably and securely receiving a foot. More particularly, the upper forms a structure that extends over instep and toe areas of the foot, along medial and lateral sides of the foot, and around a heel area of the foot. The upper may also incorporate a lacing system to adjust the fit of the footwear, as well as permitting entry and removal of the foot from the void within the upper.

SUMMARY

In one aspect, the invention provides an article of footwear having an upper, a sole structure attached to the upper, and a tensioning system disposed within the sole structure. The tensioning system includes a reel member configured to rotate about a central axis, and the reel member has a shaft extending from a first end to a second end opposite the first end. The tensioning system has a lead screw extending from the second end of the shaft and having a first set of threads. The lead screw is configured to rotate about the central axis. The tensioning system has an indicator tab mounted on the lead screw such that the indicator tab is moveable linearly along the lead screw from a first position on the lead screw to a second position on the lead screw. The tensioning system has an optical sensing unit disposed adjacent the lead screw. The reel member is configured to tighten the tensioning system by winding a lace around the shaft.

In one aspect, the invention provides an article of footwear having an upper, a sole structure attached to the upper, and a tensioning system disposed within the sole structure. The tensioning system includes a reel member configured to rotate about a central axis. The reel member has a shaft extending from a first end to a second end opposite the first end. The tensioning system includes a lead screw having a first end, a second end opposite the first end, a first set of threads extending from the first end of the lead screw to the second end of the lead screw. The lead screw extends away from the second end of the shaft. The tensioning system includes an indicator tab having a second set of threads. The tensioning system is mounted on the lead screw such that the first set of threads engage with the second set of threads. The tensioning system includes an optical sensing unit positioned adjacent the lead screw. The reel member is configured to tighten the tensioning system by winding a lace around the shaft.

In one aspect, the invention provides an article of footwear having an upper, a sole structure attached to the upper, and a tensioning system disposed within the sole structure. The tensioning system includes a reel member configured to rotate about a central axis. The reel member has a shaft extending from a first end to a second end opposite the first end. The tensioning system includes a lead screw extending away from the second end and having a first set of threads. The tensioning system including an indicator tab mounted on the lead screw such that the indicator tab has (a) a first position in which the indicator tab is disposed at a first point on the shaft and (b) a second position in which the indicator tab is disposed at a second point on the shaft that is different from the first point. The tensioning system includes an optical sensing unit positioned adjacent the lead screw. The reel member is configured to tighten the tensioning system by winding a lace around the shaft.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
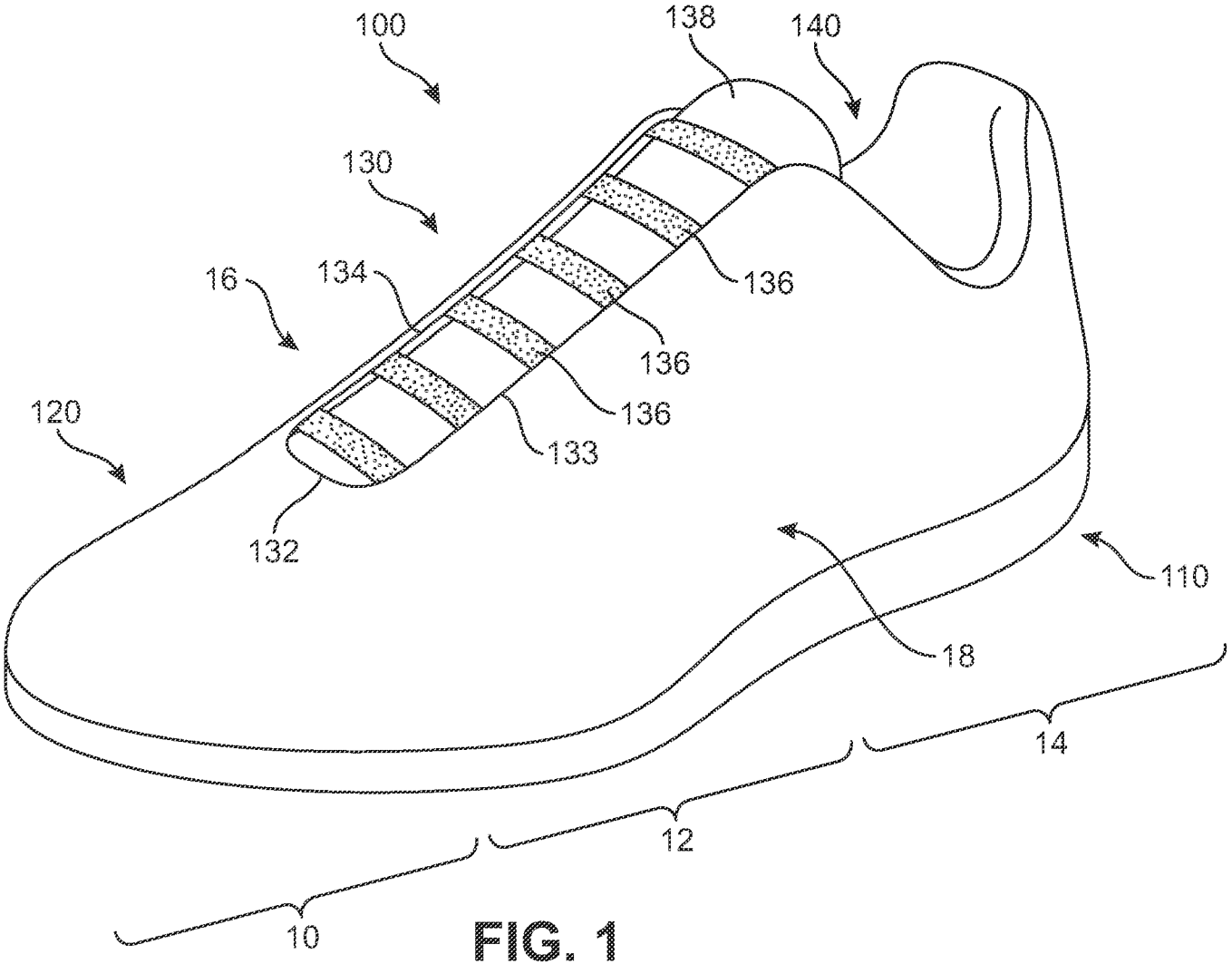
FIG. 1 is a schematic isometric view of an exemplary embodiment of an article of footwear including a tensioning system.
Figure 3:
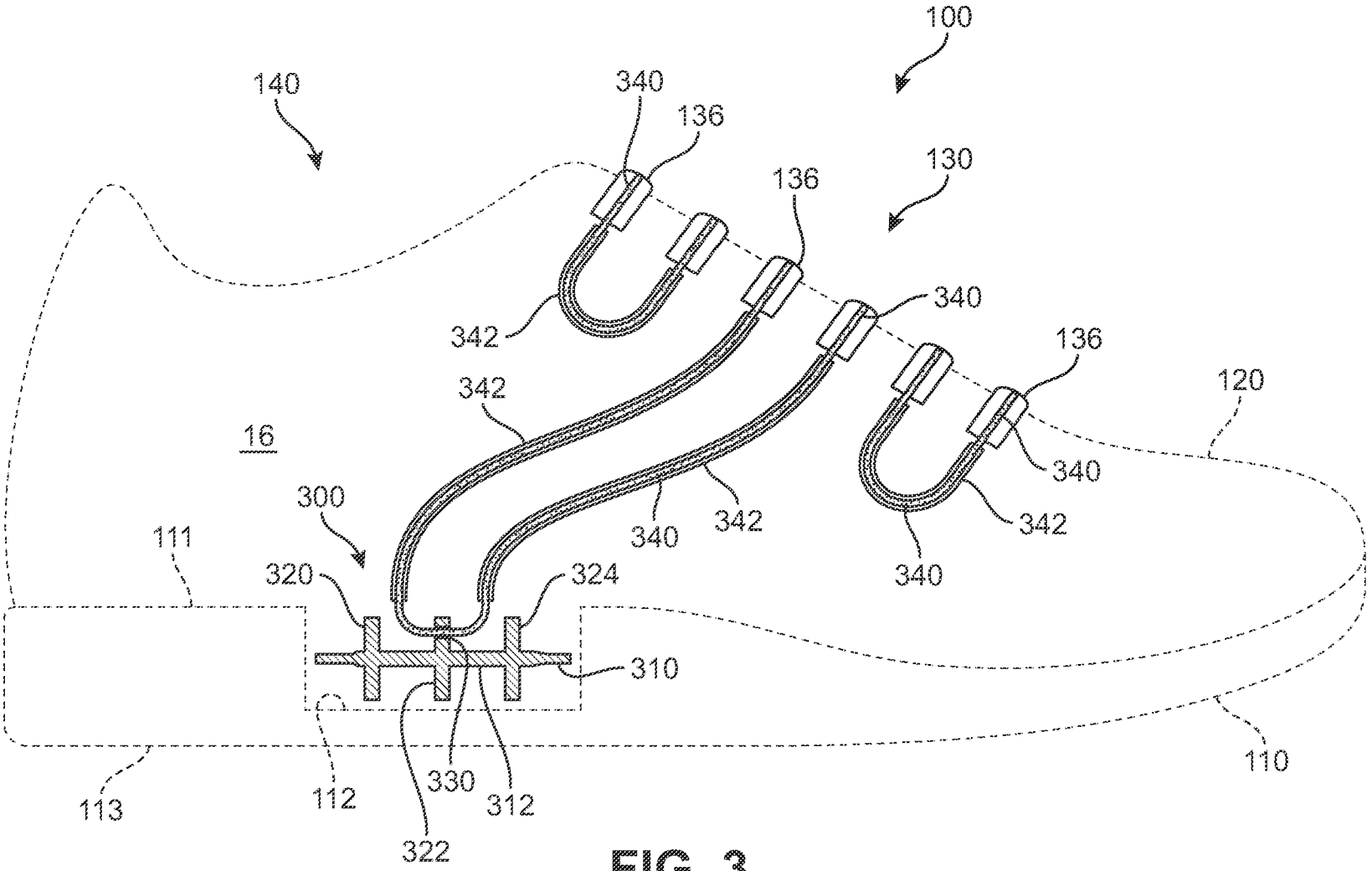
FIG. 3 is a schematic medial side view of an exemplary embodiment of a tensioning system with the article of footwear shown in phantom.

The present embodiments relate to a position sensing assembly for a tensioning system designed to provide tension to a lace, cord, or other type of strand. For example, FIGS. 1 and 3 illustrate an exemplary embodiment of an article of footwear 100 that is configured with a tensioning system 300. The tensioning system may be capable of both tightening and loosening a strand. For example, in the exemplary embodiment shown in the drawings, tensioning system 300 may both tighten and loosen a lace 340 of a lacing system 130. Details of the mechanism of tightening and loosening lace 340 are described below with respect to FIGS. 8-13. The tensioning system may include a position sensing assembly that assists in controlling the degree to which the strand is tightened and loosened. As explained in more detail below with respect to FIGS. 10-13, such a position sensing assembly may prevent tightening of the strand when the strand is meant to be loosened.

The exemplary embodiment shown in the drawings includes an article of footwear configured with a tensioning system having a position sensing assembly. However, it is understood that the tensioning system and position sensing assembly may be used with articles other than articles of footwear. As discussed in further detail below, a tensioning system may not be limited to footwear and in other embodiments a tensioning system could be used with various kinds of apparel, including clothing, sportswear, sporting equipment and other kinds of apparel. In still other embodiments, a tensioning system may be used with braces, such as medical braces.

Figure 2:
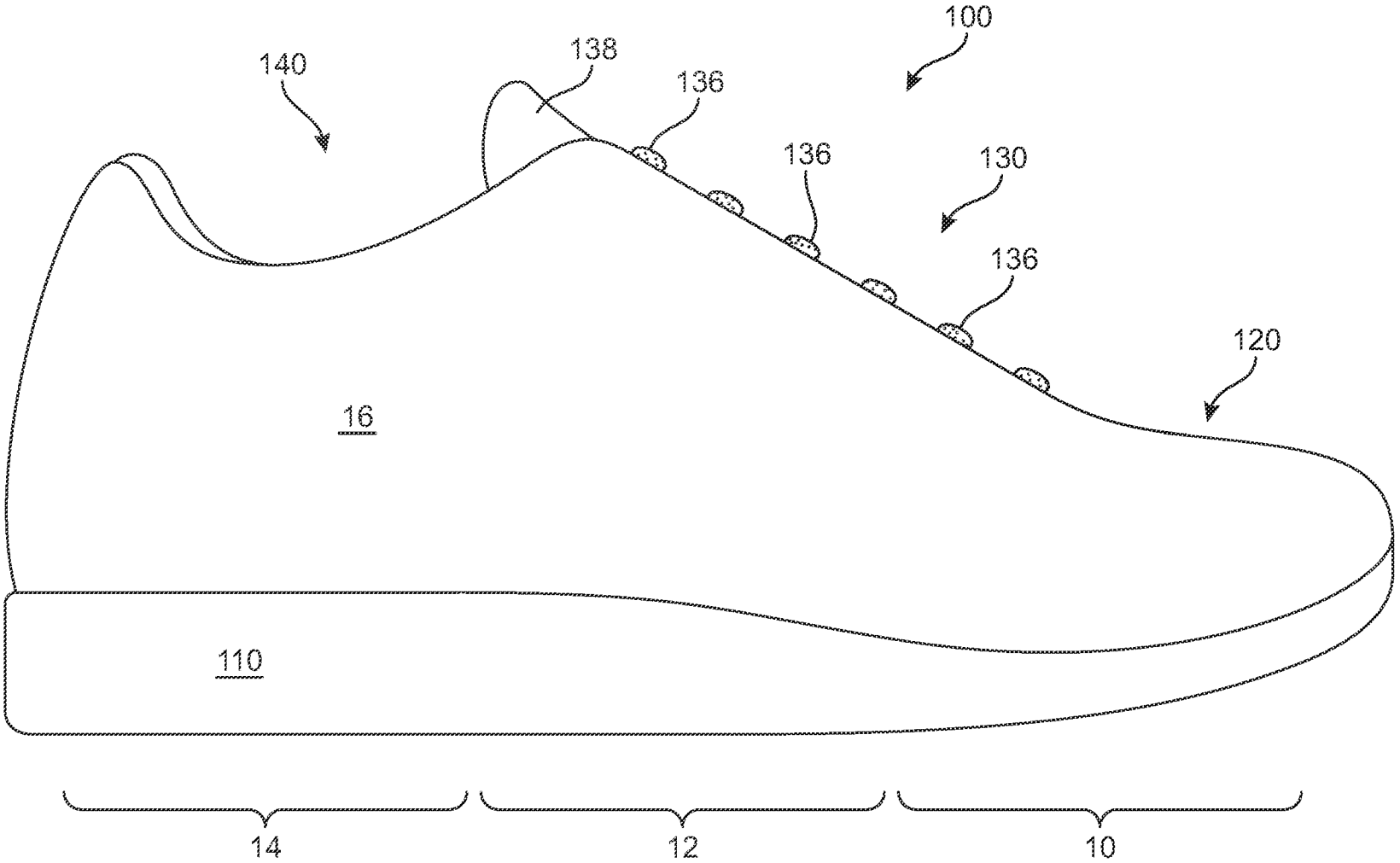
FIG. 2 is a schematic medial side view of the exemplary embodiment of an article of footwear including a tensioning system.
Figure 4:
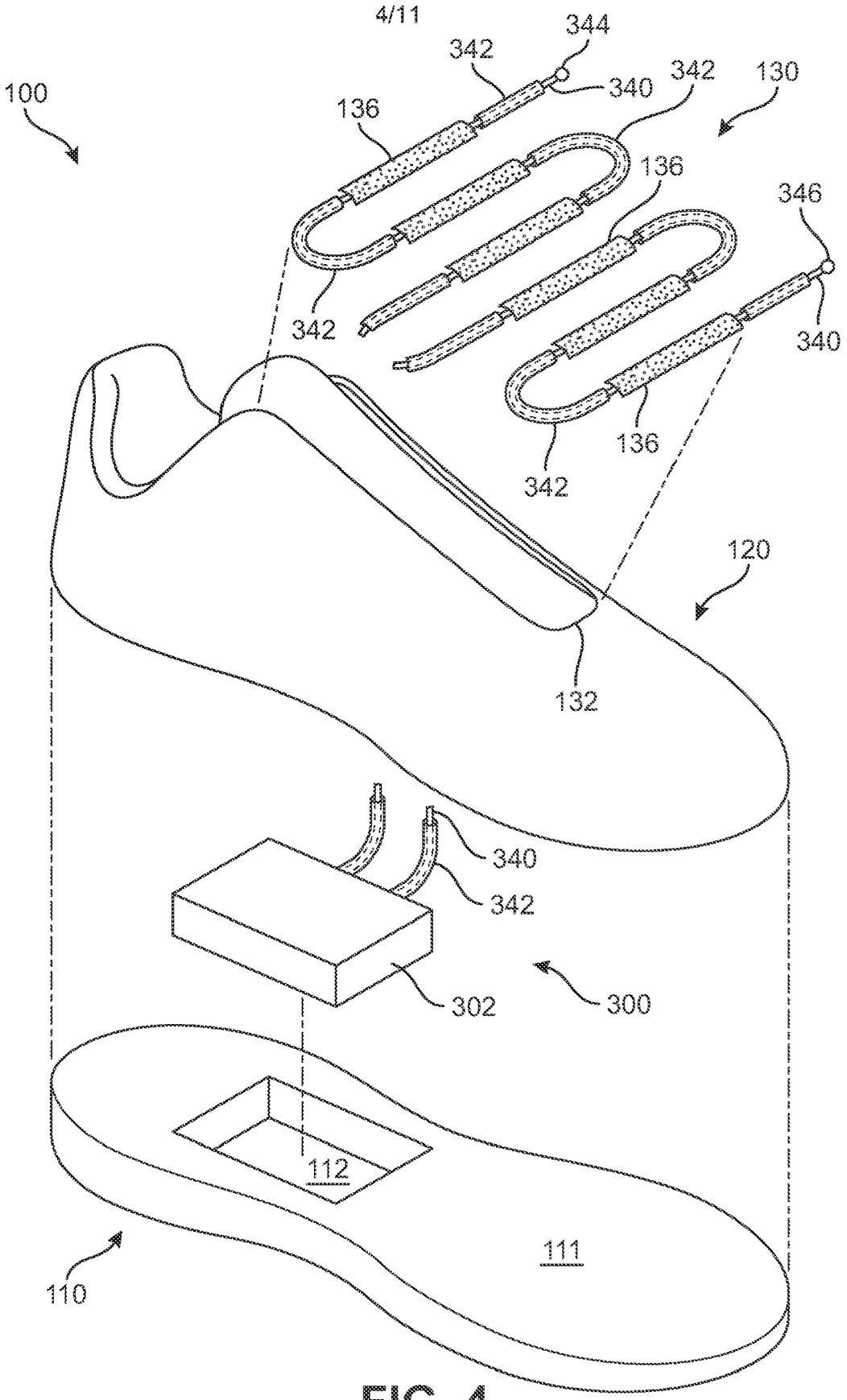
FIG. 4 is a schematic exploded view of the exemplary embodiment of an article of footwear including a tensioning system.
Figure 5:
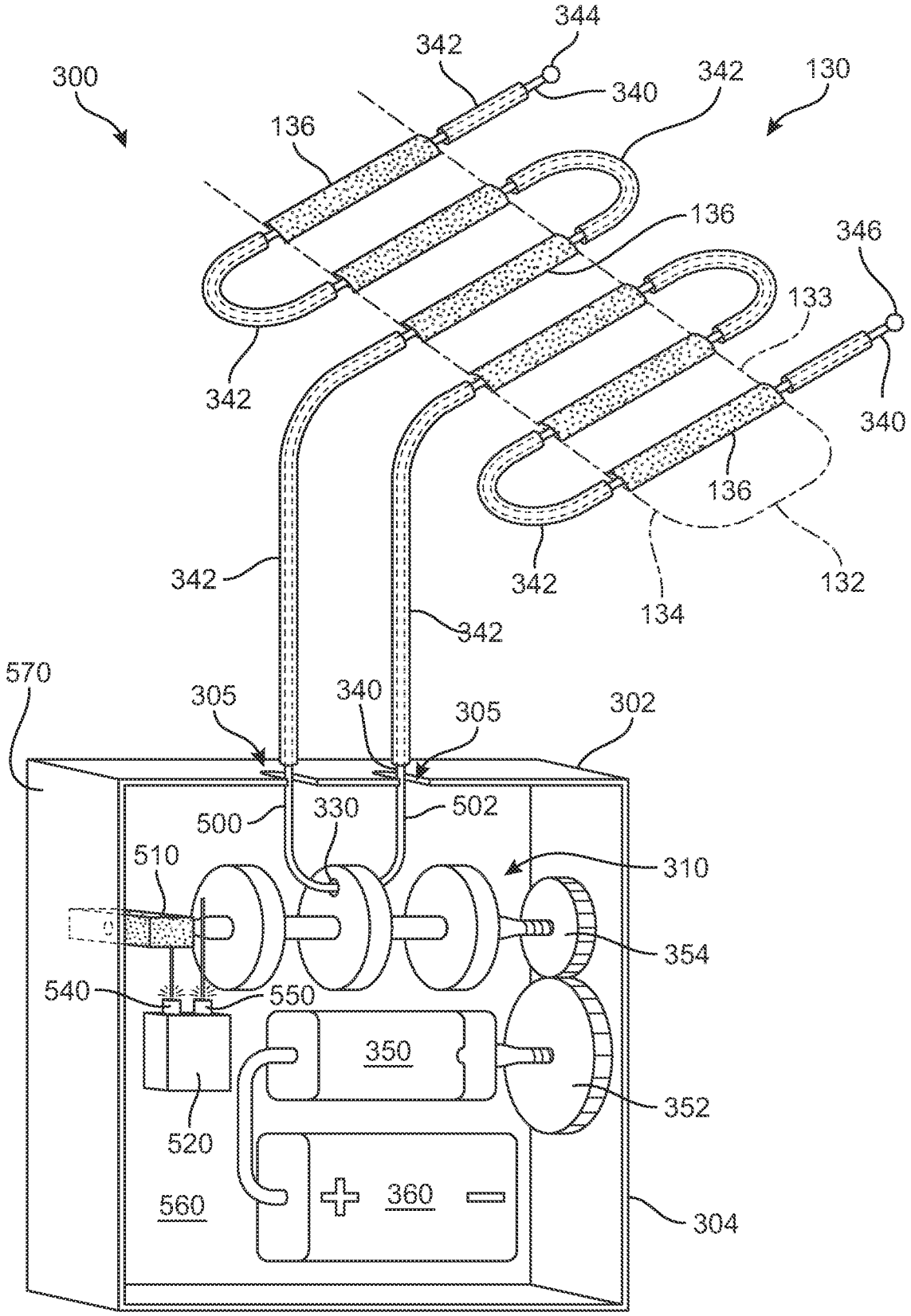
FIG. 5 is a representative exploded view of the exemplary embodiment of a tensioning system including a reel member.
Figure 6:
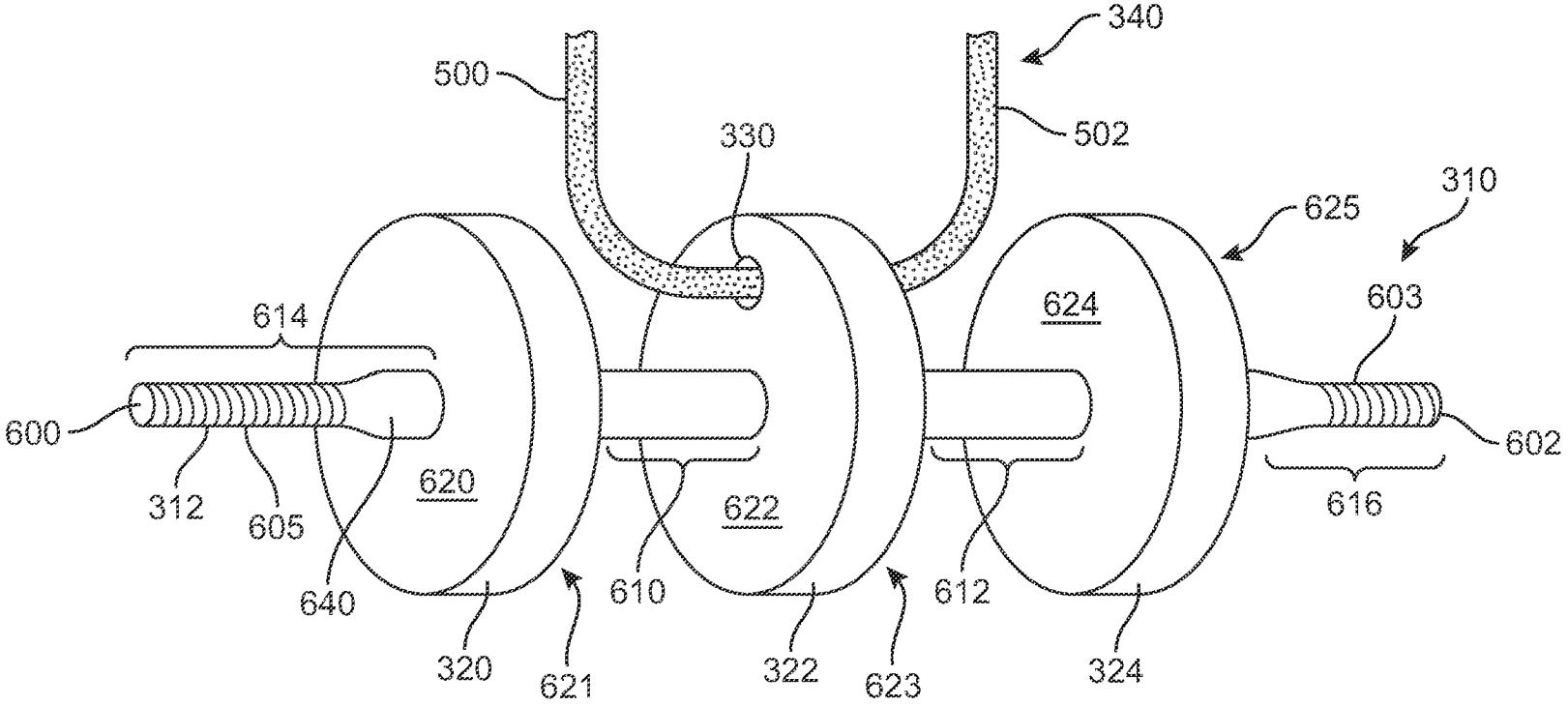
FIG. 6 is a schematic enlarged view of an exemplary embodiment of a reel member included within a tensioning system.
Figure 7:
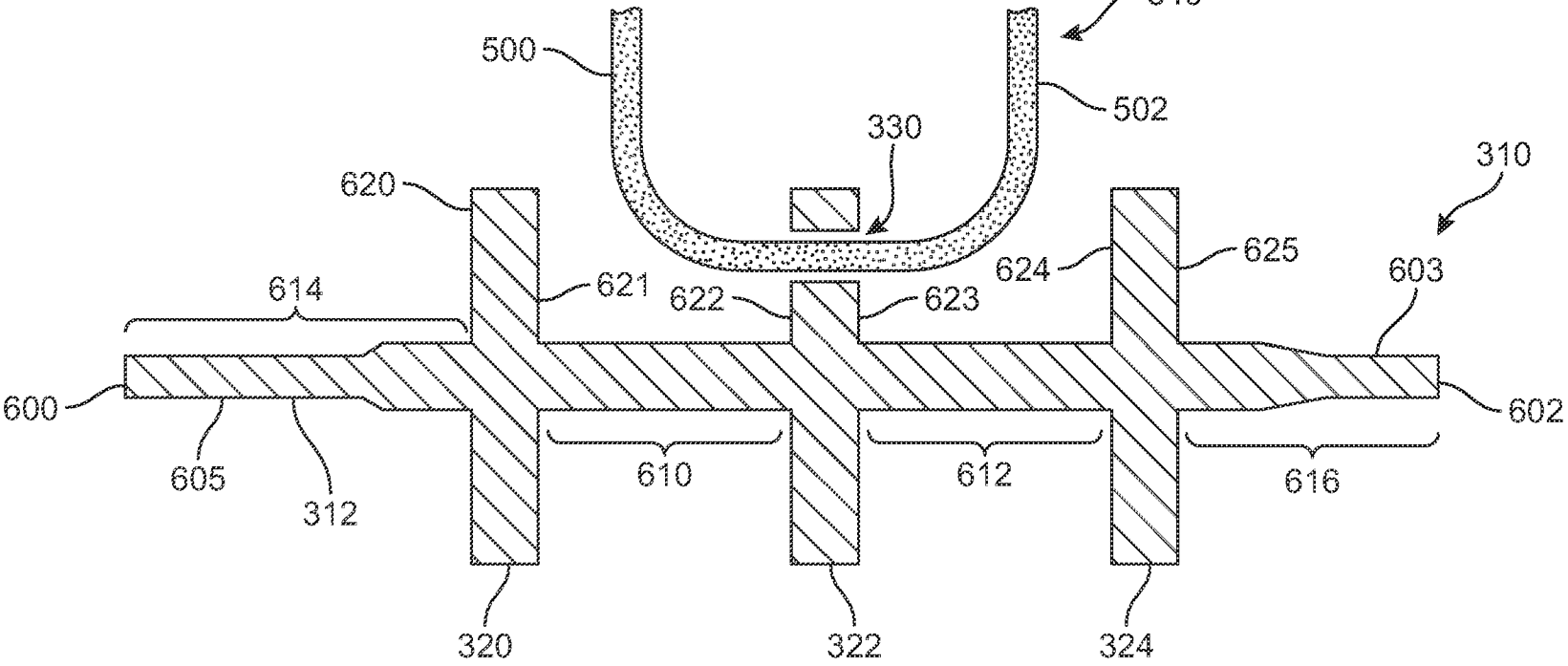
FIG. 7 is a cross-sectional view of the exemplary embodiment of a reel member included within a tensioning system.
Figure 8:
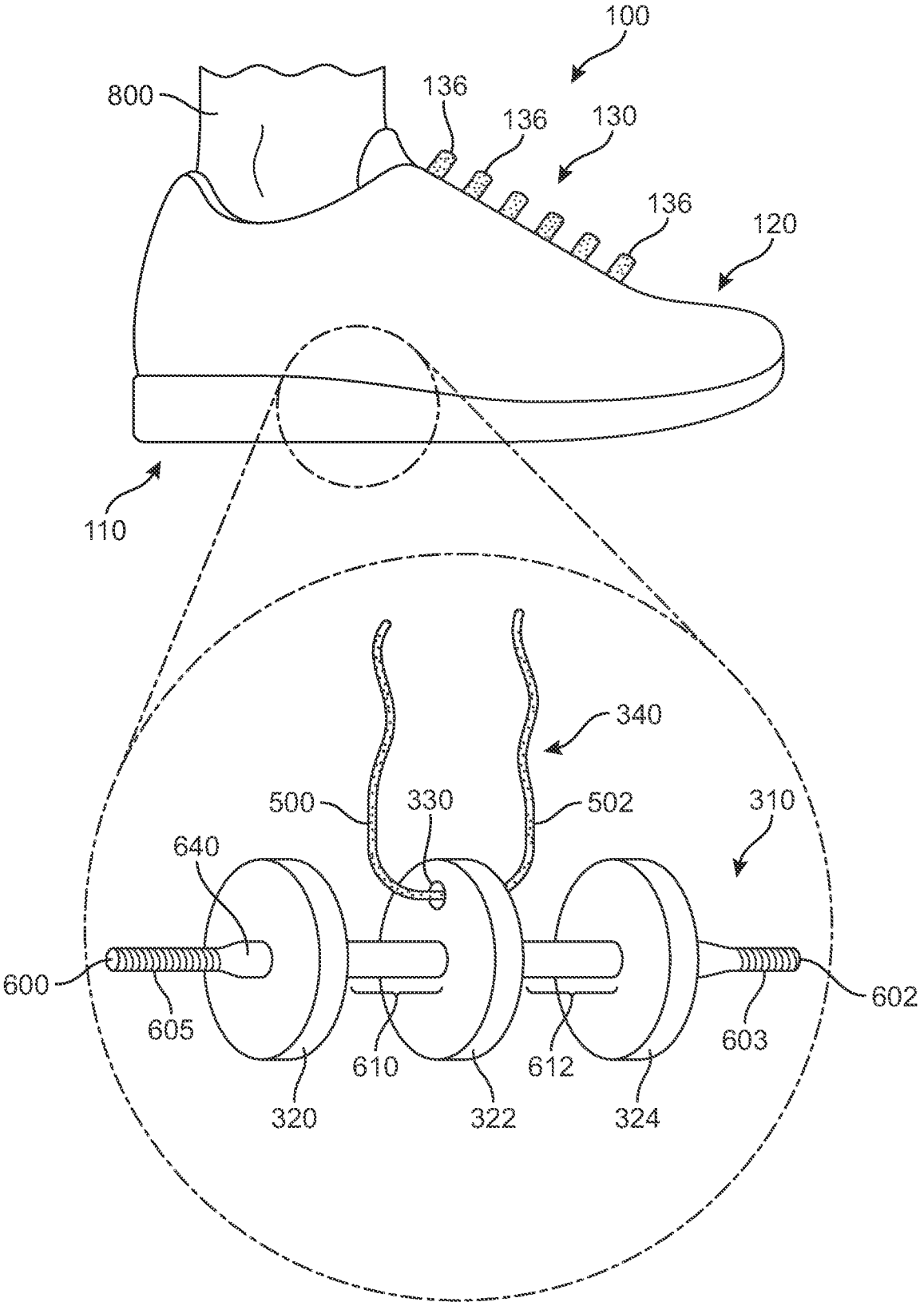
FIG. 8 is a representative view of an exemplary embodiment of a tensioning system in a loosened condition.
Figure 9:
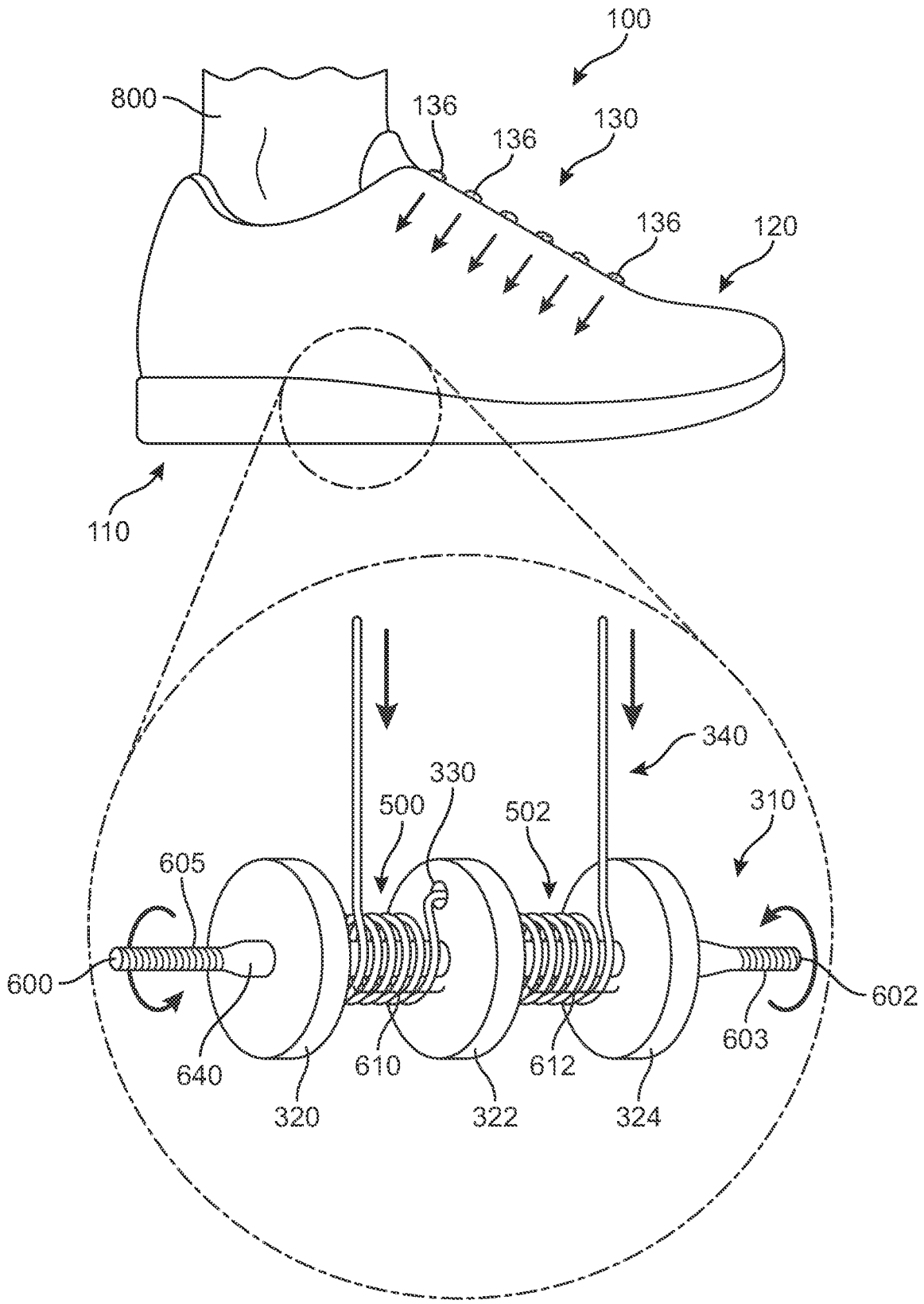
FIG. 9 is a representative view of an exemplary embodiment of a tensioning system in a tightened condition.

The Figures show how a position sensing assembly may be incorporated into a tensioning system used with an article of footwear. Thus, the Figures show features of an article of footwear, a tensioning system, and a position sensing assembly. More particularly, FIGS. 1-2 show the outward appearance of article 100. FIGS. 3-4 show how the tensioning system 300, including the position sensing assembly, interrelates with article 100. FIG. 5 provides a detailed view of features of tensioning system 300 and lacing system 130 both isolated from article 100. FIGS. 6-7 show details of a reel member 310 of tensioning system 300. FIGS. 8-9 demonstrate how tensioning system 300 may tighten and loosen lace 340 of tensioning system 300 to permit the wearer to tighten an upper 120 of article 100 around the foot, and to loosen upper 120 to facilitate entry and removal of the foot from the interior void (i.e., through throat opening 140). FIGS. 10-13 show how an optical sensing unit 520 detects the position of an indicator tab 510 disposed on a lead screw 605. The position of indicator tab 510 may indicate the relative tension of lace 340.

In the current embodiment, article of footwear 100, also referred to hereafter simply as article 100, is shown in the form of an athletic shoe. However, in other embodiments, tensioning system 300 may be used with any other kind of footwear including, but not limited to: hiking boots, soccer shoes, football shoes, sneakers, running shoes, cross-training shoes, rugby shoes, basketball shoes, baseball shoes as well as other kinds of shoes. In some embodiments article 100 may be configured for use with various kinds of non-sports related footwear, including, but not limited to: slippers, sandals, high heeled footwear, loafers as well as any other kinds of footwear.

For reference purposes, article 100 may be divided into three general regions: a forefoot region 10, a midfoot region 12, and a heel region 14, as shown in FIGS. 1 and 2. Forefoot region 10 generally includes portions of article 100 corresponding with the toes and the joints connecting the metatarsals with the phalanges. Midfoot region 12 generally includes portions of article 100 corresponding with an arch area of the foot. Heel region 14 generally corresponds with rear portions of the foot, including the calcaneus bone. Article 100 also includes a medial side 16 and a lateral side 18, which extend through each of forefoot region 10, midfoot region 12, and heel region 14 and correspond with opposite sides of article 100. More particularly, medial side 16 corresponds with an inside area of the foot (i.e., the surface that faces toward the other foot), and lateral side 18 corresponds with an outside area of the foot (i.e., the surface that faces away from the other foot). Forefoot region 10, midfoot region 12, and heel region 14 and medial side 16, lateral side 18 are not intended to demarcate precise areas of article 100. Rather, forefoot region 10, midfoot region 12, and heel region 14, and medial side 16, lateral side 18 are intended to represent general areas of article 100 to aid in the following discussion. In addition to article 100, forefoot region 10, midfoot region 12, and heel region 14 and medial side 16, lateral side 18 may also be applied to a sole structure, an upper, and individual elements thereof.

For consistency and convenience, directional adjectives are also employed throughout this detailed description corresponding to the illustrated embodiments. The term "lateral" or "lateral direction" as used throughout this detailed description and in the claims refers to a direction extending along a width of a component or element. For example, a lateral direction of article 100 may extend between medial side 16 and lateral side 18. Additionally, the term "longitudinal" or "longitudinal direction" as used throughout this detailed description and in the claims refers to a direction extending across a length or breadth of an element or component (such as a sole structure or an upper). In some embodiments, a longitudinal direction of article 100 may extend from forefoot region 10 to heel region 14. It will be understood that each of these directional adjectives may also be applied to individual components of an article of footwear, such as an upper and/or a sole structure. In addition, a vertical direction refers to a direction perpendicular to a horizontal surface defined by the longitudinal direction and the lateral direction. It will be understood that each of these directional adjectives may be applied to various components shown in the embodiments, including article 100, as well as components of a tensioning system 300.

In some embodiments, article of footwear 100 may include a sole structure 110 and an upper 120. Generally, upper 120 may be any type of upper. In particular, upper 120 may have any design, shape, size and/or color. For example, in embodiments where article 100 is a basketball shoe, upper 120 could be a high top upper that is shaped to provide high support on an ankle. In embodiments where article 100 is a running shoe, upper 120 could be a low top upper.

In some embodiments, sole structure 110 may be configured to provide traction for article 100. In addition to providing traction, sole structure 110 may attenuate ground reaction forces when compressed between the foot and the ground during walking, running or other ambulatory activities. The configuration of sole structure 110 may vary significantly in different embodiments to include a variety of conventional or non-conventional structures. In some cases, the configuration of sole structure 110 can be configured according to one or more types of ground surfaces on which sole structure 110 may be used. Examples of ground surfaces include, but are not limited to: natural turf, synthetic turf, dirt, as well as other surfaces.

In different embodiments, sole structure 110 may include different components. For example, sole structure 110 may include an outsole, a midsole, and/or an insole. In addition, in some cases, sole structure 110 can include one or more cleat members or traction elements that are configured to increase traction with a ground surface.

In an exemplary embodiment, sole structure 110 is secured to upper 120 and extends between the foot and the ground when article 100 is worn. Upper 120 defines an interior void within article 100 for receiving and securing a foot relative to sole structure 110. The void is shaped to accommodate the foot and extends along a lateral side of the foot, along a medial side of the foot, over the foot, around the heel, and under the foot. Upper 120 may also include a collar that is located in at least heel region 14 and forms a throat opening 140. Access to the interior void of upper 120 is provided by throat opening 140. More particularly, the foot may be inserted into upper 120 through throat opening 140, and the foot may be withdrawn from upper 120 through throat opening 140.

In some embodiments, article 100 can include a lacing system 130. Lacing system 130 extends forward from the collar and throat opening 140 in heel region 14 over a lacing area 132 corresponding to an instep of the foot in midfoot region 12 to an area adjacent to forefoot region 10. Lacing area 132 extends between a lateral edge 133 and a medial edge 134 on opposite sides of upper 120. Lacing system 130 includes various components configured to secure a foot within upper 120 of article 100 and, in addition to the components illustrated and described herein, may further include additional or optional components conventionally included with footwear uppers.

In this embodiment, a plurality of strap members 136 extends across portions of lacing area 132. Together with tensioning system 300 (described in detail below), plurality of strap members 136 assist the wearer to modify dimensions of upper 120 to accommodate the proportions of the foot. In the exemplary embodiments, plurality of strap members 136 extend laterally across lacing area 132 between lateral edge 133 and medial edge 134. As will be further described below, strap members 136 and a lace 340 of tensioning system 300 permit the wearer to tighten upper 120 around the foot, and to loosen upper 120 to facilitate entry and removal of the foot from the interior void (i.e., through throat opening 140).

In some embodiments, upper 120 includes a tongue 138 that extends over a foot of a wearer when disposed within article 100 to enhance the comfort of article 100. In this embodiment, tongue 138 extends through lacing area 132 and can move within an opening between opposite lateral edge 133 and medial edge 134 of upper 120. In some cases, tongue 138 can extend between a lace and/or strap members 136 to provide cushioning and disperse tension applied by the lace or strap members 136 against a top of a foot of a wearer. With this arrangement, tongue 138 can enhance the comfort of article 100.

Some embodiments may include provisions for facilitating the adjustment of an article to a wearer's foot, including tightening and/or loosening the article around the wearer's foot. In some embodiments, these provisions may include a tensioning system. In some embodiments, a tensioning system may further include other components that include, but are not limited to, a tensioning member, lacing guides, a tensioning assembly, a housing unit, a motor, gears, spools or reels, and/or a power source. Such components may assist in securing, adjusting tension, and providing a customized fit to a wearer's foot. These components and how, in various embodiments, they may secure the article to a wearer's foot, adjust tension, and provide a customized fit will be explained further in detail below.

Referring now to FIG. 3, article 100 includes an exemplary embodiment of a tensioning system 300. Embodiments of tensioning system 300 may include any suitable tensioning system, including incorporating any of the systems disclosed in one or more of Beers et al., U.S. Patent Application Publication Number 2014/0068838, now U.S. application Ser. No. 14/014,491, filed Aug. 20, 2013, and titled "Motorized Tensioning System"; Beers, U.S. Patent Application Publication Number 2014/0070042, now U.S. application Ser. No. 14/014,555, filed Aug. 20, 2013 and titled "Motorized Tensioning System with Sensors"; and Beers, U.S. Patent Application Publication Number 2014/0082963, now U.S. application Ser. No. 14/032,524, filed Sep. 20, 2013 and titled "Footwear Having Removable Motorized Adjustment System"; which applications are hereby incorporated by reference in their entirety (collectively referred to herein as the "Automatic Lacing cases").

In different embodiments, a tensioning system may include a tensioning member. The term "tensioning member" as used throughout this detailed description and in the claims refers to any component that has a generally elongated shape and high tensile strength. In some cases, a tensioning member could also have a generally low elasticity. Examples of different tensioning members include, but are not limited to: laces, cables, straps and cords. In some cases, tensioning members may be used to fasten and/or tighten an article, including articles of clothing and/or footwear. In other cases, tensioning members may be used to apply tension at a predetermined location for purposes of actuating some components or system.

In an exemplary embodiment, tensioning system 300 includes a tensioning member in the form of a lace 340. Lace 340 is configured to modify the dimensions of the interior void of upper 120 and to thereby tighten (or loosen) upper 120 around a wearer's foot. In one embodiment, lace 340 may be configured to move plurality of strap members 136 of lacing system 130 so as to bring opposite lateral edge 133 and medial edge 134 of lacing area 132 closer together to tighten upper 120. Similarly, lace 340 may also be configured to move plurality of strap members 136 in the opposite direction to move lateral edge 133 and medial edge 134 further apart to loosen upper 120. With this arrangement, lace 340 may assist with adjusting tension and/or fit of article 100. As discussed in more detail below, the position sensing assembly may help control how much lace is wound around the shaft.

In some embodiments, lace 340 may be connected or joined to strap members 136 so that movement of lace 340 is communicated to plurality of strap members 136. For example, lace 340 may be bonded, stitched, fused, or attached using adhesives or other suitable mechanisms to attach portions of lace 340 extending across lacing area 132 to each strap member of plurality of strap members 136. With this arrangement, when tension is applied to lace 340 via tensioning system 300 to tighten or loosen lacing system 130, lace 340 can move strap members 136 between an open or closed position.

In some embodiments, lace 340 may be configured to pass through various lacing guides 342 that route lace 340 across portions of upper 120. In some cases, ends of lacing guides 340 may terminate adjacent to lateral edge 133 and medial edge 134 of lacing area 132. In some cases, lacing guides 342 may provide a similar function to traditional eyelets on uppers. In particular, as lace 340 is pulled or tensioned, lacing area 132 may generally constrict so that upper 120 is tightened around a foot. In one embodiment, lacing guides 342 may be routed or located between layers of the material forming upper 120, including any interior layers or linings.

In some embodiments, lacing guides 342 may be used to arrange lace 340 in a predetermined configuration on upper 120 of article 100. Referring to FIGS. 3-5, in one embodiment, lace 340 is arranged in a serpentine, or alternating-sides, configuration on upper 120. In some other embodiments, lace 340 may be arranged, via lacing guides 342, in different configurations.

In some embodiments, tensioning system 300 includes a reel member 310. Reel member 310 is a component within a tensioning device 302 of tensioning system 300. Reel member 310 is configured to be rotated around a central axis in opposite directions to wind and/or unwind lace 340 and thereby tighten or loosen tensioning system 300.

In an exemplary embodiment, reel member 310 is a reel or spool having a shaft 312 running along the central axis and a plurality of flanges extending radially outward from shaft 312. The plurality of flanges can have a generally circular or round shape with shaft 312 disposed within the center of each flange. The flanges assist with keeping the wound portions of lace 340 separated and organized on reel member 310 so that lace 340 does not become tangled or bird-nested during winding or unwinding when tensioning system 300 is tightened or loosened.

In an exemplary embodiment, reel member 310 may include a center flange 322 located approximately at a midpoint along shaft 312 of reel member 310. Center flange 322 may include an aperture 330 that forms an opening extending between opposite faces of center flange 322. Aperture 330 is configured to receive lace 340. As shown in FIG. 3, lace 340 extends through aperture 330 in center flange 322 from one side or face of center flange to the other side or opposite face. With this arrangement, portions of lace 340 are disposed on opposite sides of center flange 322 and lace 340 is interconnected to reel member 310.

In one embodiment, reel member 310 may include at least three flanges on shaft 312. In this embodiment, reel member 310 includes a first end flange 320, center flange 322, and a second end flange 324. Center flange 322 is located along shaft 312 between first end flange 320 and second end flange 324. First end flange 320 and second end flange 324 are located on shaft 312 at opposite ends of reel member 310 on either side of center flange 322. First end flange 320 and/or second end flange 324 may assist with keeping portions of lace 340 that are wound on reel member 310 from sliding off the ends of reel member 310 and may also assist with preventing lace 340 from becoming tangled or bird-nested during winding or unwinding when tensioning system 300 is tightened or loosened.

In some embodiments, tensioning assembly 302 of tensioning system 300 may be located within a cavity 112 in sole structure 110. Sole structure 110 can include an upper surface 111 that is disposed adjacent to upper 120 on a top of sole structure 110. Upper surface 111 may be directly or indirectly attached or joined to upper 120 or a component of upper 120 to secure sole structure 110 and upper 120 together. Sole structure 110 may also include a lower surface or ground-engaging surface 113 that is disposed opposite upper surface 111. Ground-engaging surface 113 may be an outsole or other component of sole structure 110 that is configured to be in contact with a ground surface when article 100 is worn.

In an exemplary embodiment, cavity 112 is an opening in sole structure extending from upper surface 111 towards lower surface 113. Tensioning assembly 302 of tensioning system 300 may be inserted within cavity 112 from the top of sole structure 110. In an exemplary embodiment, cavity 112 has an approximately rectangular shape that corresponds with a rectangular shape of tensioning assembly 302. In addition, cavity 112 may be of a similar size and dimension as tensioning assembly 302 so that tensioning assembly 302 conformably fits within cavity 112. With this arrangement, tensioning assembly 302 and related components may be protected from contact with a ground surface by lower surface 113 when article 100 is worn.

Referring now to FIG. 4, an exploded view of article 100, including sole structure 110, upper 120, lacing system 130, and tensioning system 300 are illustrated. In this embodiment, the configuration of lace 340 through lacing guides 342 can be seen alternately extending across lacing area 132 of upper 120 between medial edge 134 on medial side 16 and lateral edge 133 on lateral side 18.

In addition, to facilitate lace 340 being able to tighten and loosen tensioning system 300, ends of lace 340 are anchored to upper 120 at different locations. As shown in FIG. 4, a first anchor 344 secures one end of lace 340 to upper 120 near or adjacent to throat opening 140 in heel region 14 of upper 120 and a second anchor 346 secures the opposite end of lace 340 to upper 120 near or adjacent to forefoot region 10. First anchor 344 and second anchor 346 may be attached or joined to upper 120 may any suitable mechanism, including, but not limited to, knotting, bonding, sewing, adhesives, or other forms of attachment.

FIG. 5 illustrates an exploded view of an exemplary embodiment of components of tensioning system 300 including reel member 310, lace 340, and a position sensing assembly. In some embodiments, tensioning system 300 can include tensioning assembly 302 that is configured to adjust the tension of components of lacing system 130, including lace 340 and/or strap members 136, to secure, adjust, and modify the fit of article 100 around a wearer's foot. Tensioning assembly 302 may be any suitable device for adjusting tension of a tensioning member, such as a lace or strap, and can include any of the devices or mechanisms described in the Automatic Lacing cases described above.

Referring to FIG. 5, some components of tensioning assembly 302 are shown within a portion of a housing unit 304. In some embodiments, housing unit 304 may be shaped so as to optimize the arrangement of components of tensioning assembly 302. In one embodiment, tensioning assembly 302 includes housing unit 304 that has an approximately rectangular shape. However, it should be understood that the shape and configuration of housing unit 304 may be modified in accordance with the type and configuration of tensioning assembly used within tensioning system 300.

In this embodiment, tensioning assembly 302 includes reel member 310 that is mechanically coupled to a motor 350. In some embodiments, motor 350 could include an electric motor. However, in other embodiments, motor 350 could comprise any kind of non-electric motor known in the art. Examples of different motors that can be used include, but are not limited to: DC motors (such as permanent-magnet motors, brushed DC motors, brushless DC motors, switched reluctance motors, etc.), AC motors (such as motors with sliding rotors, synchronous electrical motors, asynchronous electrical motors, induction motors, etc.), universal motors, stepper motors, piezoelectric motors, as well as any other kinds of motors known in the art.

Motor 350 may further include a crankshaft 352 that can be used to drive one or more components of tensioning assembly 302. For example, a gear 354 may be mechanically coupled to reel member 310 and may be driven by crankshaft 352 of motor 350. With this arrangement, reel member 310 may be placed in communication with motor 350 to be rotated in opposite directions around a central axis.

For purposes of reference, the following detailed description uses the terms "first rotational direction" and "second rotational direction" in describing the rotational directions of one or more components about a central axis. For purposes of convenience, the first rotational direction and the second rotational direction refer to rotational directions about central axis of shaft 312 of reel member 310 and are generally opposite rotational directions. The first rotational direction may refer to the counterclockwise rotation of a component about the central axis, when viewing the component from the vantage point of a first end 600 of shaft 312. The second rotational direction may be then be characterized by the clockwise rotation of a component about the central axis, when viewing the component from the same vantage point.

In some embodiments, tensioning assembly 302 may include provisions for powering motor 350, including a power source 360. Power source 360 may include a battery and/or control unit (not shown) configured to power and control tensioning assembly 302 and motor 350. Power source 360 may be any suitable battery of one or more types of battery technologies that could be used to power motor 350 and tensioning system 302. One possibly battery technology that could be used is a lithium polymer battery. The battery (or batteries) could be rechargeable or replaceable units packaged as flat, cylindrical, or coin shaped. In addition, batteries could be single cell or cells in series or parallel. Other suitable batteries and/or power sources may be used for power source 360.

In the embodiments shown, motor 350, power source 360, reel member 310, crankshaft 352, and gear 354 are all disposed in housing unit 304, along with additional components, such as control unit or other elements, which may function to receive and protect all of these components within tensioning assembly 302. In other embodiments, however, any one or more of these components could be disposed in any other portions of an article, including the upper and/or sole structure.

Housing unit 304 includes openings 305 that permit lace 340 to enter into tensioning assembly 302 and engage reel member 310. As discussed above, lace 340 extends through aperture 330 in center flange 322 of reel member 310 to interconnect lace 340 with reel member 310. When lace 340 is disposed through aperture 330 of center flange 322, lace 340 may include a first lace portion 500 located on one side of center flange 322 and a second lace portion 502 located on the opposite side of center flange 322. Accordingly, openings 305 in housing unit 304 allow both first lace portion 500 and second lace portion 502 of lace 340 to wind and unwind around reel member 310 within the inside of housing unit 304 of tensioning assembly 302.

Referring now to FIG. 6, an enlarged view of an exemplary embodiment of reel member 310 is illustrated. In this embodiment, reel member 310 has a central axis that extends along a longitudinal length of reel member 310 from a first end 600 to a second end 602. As described above, reel member 310 is configured to rotate about the central axis in a first rotational direction and an opposite second rotational direction to wind or unwind lace 340 around portions of shaft 312. In addition, reel member 310 may include a screw 603 disposed at second end 602 that is configured to engage with one or more gear assembly components, including gear 354 and/or crankshaft 352, so as to be in communication with motor 350. With this configuration, motor 350 may rotate reel member 310 about the central axis in the first rotational direction and the second rotational direction.

In some embodiments, reel member 310 may include a lead screw 605 disposed at first end 600. As discussed in more detail below, lead screw 605 may be part of the position sensing assembly.

In some embodiments, portions of shaft 312 of reel member 310 may be described with reference to the plurality of flanges extending away from shaft 312. For example, a first shaft section 610 extends between first end flange 320 and center flange 322 and a second shaft section 612 extends between second end flange 324 and center flange 322. Shaft 312 may also include a third shaft section 614 extending from first end flange 320 to first end 600 and a fourth shaft section 616 extending from second end flange 324 to second end 602. In some embodiments, screw 603 may be disposed on fourth shaft section 616. In some embodiments, lead screw 605 may be disposed on third shaft section 614.

In some embodiments, each of the plurality of flanges has two opposing faces with surfaces that are oriented towards opposite ends of reel member 310. For example, first end flange 320 has an outer face 620 having a surface oriented towards first end 600 of shaft 312 and an opposite inner face 621 having a surface oriented towards second end 602. Similarly, second end flange 324 has an outer face 625 having a surface oriented towards second end 602 and an opposite inner face 624 having a surface oriented towards first end 600 of shaft 312. Center flange 322 includes a first face 622 and an opposite second face 623. First face 622 of center flange 322 has a surface oriented towards first end 600 of shaft 312 and facing inner face 621 of first end flange 320. Second face 623 of center flange 322 has a surface oriented towards second end 602 of shaft 312 and facing inner face 624 of second end flange 324.

In an exemplary embodiment, center flange 322 includes aperture 330, described above. Aperture 330 extends between first face 622 and second face 623 of center flange 322 and provides an opening that allows lace 340 to extend between the opposite sides or faces of center flange 322. In some embodiments, center flange 322 extends radially outward from shaft 312 and aperture 330 is located on center flange 322 so as to be spaced apart from shaft 312. In this embodiment, aperture 330 is located adjacent to a perimeter edge of center flange 322. In different embodiments, the distance between the perimeter edge of center flange 322 and the location of aperture 330 may vary. For example, the distance may be determined on the basis of revolution rate of tensioning assembly 302 and/or motor 350 or may be determined on the basis of the desired tension within tensioning system 300.

As shown in FIG. 6, when lace 340 extends through aperture 330 in center flange 322, lace 340 can include a first lace portion 500 disposed on one side of center flange 322 and a second lace portion 502 disposed on the opposite side of center flange 322. In this embodiment, first lace portion 500 is disposed on the side of center flange 322 that corresponds with first face 622 and second lace portion 502 is disposed on the side of center flange 322 that corresponds with second face 623. With this arrangement, lace 340 may be interconnected to reel member 310.

As will be further described below, reel member 310 is operable to be rotated in the first rotational direction or the second rotational direction to wind or unwind lace 340 and thereby tighten or loosen tensioning system 300. For example, motor 350 and/or an associated control unit of tensioning system 300 can be used to control rotation of reel member 310, including automatic operation and/or based on user inputs. When tensioning system 300 is tightened, reel member 310 rotates while lace 340 is interconnected to center flange 322 at aperture 330. This rotation causes first lace portion 500 and second lace portion 502 to be wound onto portions of shaft 312 on opposite sides of center flange 322. Specifically, first lace portion 500 is wound onto first shaft section 610 and second lace portion 502 is wound onto second shaft section 612.

In this embodiment, first face 622 of center flange 322 and inner face 621 of first end flange 320 serve as boundaries or walls on the ends of first shaft section 610 to assist with keeping first lace portion 500 located on first shaft section 610 of reel member 310 during winding and unwinding of lace 340 with tensioning assembly 302. In a similar manner, second face 623 of center flange 322 and inner face 624 of second end flange 324 serve as boundaries or walls on the ends of second shaft section 612 to assist with keeping second lace portion 502 located on second shaft section 612 of reel member 310 during winding and unwinding of lace 340 with tensioning assembly 302. With this arrangement, lace 340, including first lace portion 500 and second lace portion 502, may be prevented from getting tangled or bird-nested during operation of tensioning system 300.

FIG. 7 illustrates a cross-sectional view of reel member 310 and shows the interconnection of lace 340 with reel member 310 within tensioning system 300. In this embodiment, first lace portion 500 of lace 340 extends through aperture 330 in the surface of first face 624 of center flange 322 and second lace portion 502 of lace 340 outwards from aperture 330 in the surface of second face 623 on the opposite side of center flange 322. With this arrangement, lace 340 is interconnected to reel member 310 via aperture 330 in center flange 322 such that rotation of reel member 310 about the central axis will cause first lace portion 500 and second lace portion 502 to respectively wind about first shaft section 610 and second shaft section 612.

In some embodiments, tensioning system 300 is operable to be controlled between at least a tightened condition and a loosened condition. In different embodiments, however, it should be understood that tensioning system 300 may be controlled to be placed into various degrees or amounts of tension that range between a fully tightened and a fully loosened condition. In addition, tensioning system 300 may include predetermined tension settings or user-defined tension settings. The position sensing assembly may be used to determine whether the tensioning system 300 is in the tightened condition, a loosened condition, or a condition that is in between the tightened condition and the loosened condition. FIGS. 8 and 9 illustrate exemplary embodiments of tensioning system 300 being operated between a loosened condition (FIG. 8) and a tightened condition (FIG. 9). It should be understood that the method of tightening and/or loosening tensioning system 300 using tensioning assembly 302 may be performed in reverse order to loosen tensioning system 300 from the tightened condition to the loosened condition. FIGS. 10-13 illustrate exemplary embodiments of a position sensing assembly using optical sensing unit 520 to sense a position of indicator tab 510. The position of indicator tab 510 may indicate the condition of tensioning system 300.

Referring now to FIG. 8, an exemplary embodiment of tensioning system 300 in a loosened condition is illustrated. In this embodiment, a foot 800 of a wearer is inserted into article 100 with tensioning system 300 in an initially loosened condition. In the loosened condition, lacing system 130 and plurality of strap members 136 are unfastened or in an open position to allow entrance of foot 800 within the interior void of upper 120. Lace 340 is connected to strap members 136 of lacing system 130 and is also interconnected to reel member 310 of tensioning assembly 302 by being disposed through aperture 330 in central flange 322 of reel member 310. With this arrangement, winding of lace 340 around portions of reel member 310 will cause tension in lace 340 to pull plurality of strap members 136 of lacing system 130 to a closed position and tighten upper 120 around foot 800 when tensioning system 300 is in the tightened condition.

FIG. 9 illustrates an exemplary embodiment of tensioning system 300 in a tightened condition. In this embodiment, tensioning device 302 rotates reel member 310 in the first rotational direction (e.g., counterclockwise) about the central axis to apply tension to lace 340 and tighten tensioning system 300. The interconnection of lace 340 to central flange 322 through aperture 330 causes first lace portion 500 to wind around first shaft section 610 and second lace portion 502 to wind around second shaft section 612 when reel member 310 is rotated in the first rotational direction. The tension applied to lace 340 and transmitted from lace 340 to plurality of strap members 136 moves lacing system 130 to a closed position to secure upper 120 around foot 800 when tensioning system 300 is in the tightened condition.

Similarly, rotation of reel member 310 can be made in the opposite second rotational direction to unwind lace 340 from portions of shaft 312 to return tensioning system 300 to the loosened condition, as shown in FIG. 8 above. In addition, in some embodiments, rotation of reel member 310 in the second rotational direction may be performed by motor 350, by a user manually pulling on lace 340, and/or strap members 136, or both.

In an exemplary embodiment, rotation of reel member 310 in either or both of the first rotational direction and the second rotational direction will cause lace 340 to wind or unwind substantially equally around portions of shaft 312 of reel member 310. That is, the amount of first lace portion 500 wound on first shaft section 610 and the amount of second lace portion 502 wound on second shaft section 612 will be approximately equal on opposite sides of central flange 322 when tensioning system 300 is in the tightened condition. Similarly, during unwinding of lace 340 from reel member 310, approximately equal portions of lace 340 are unwound from opposite sides of center flange 322 when tensioning system 300 is placed in the loosened condition from the tightened condition. That is, the amount of first lace portion 500 unwound or spooled out from first shaft section 610 and the amount of second lace portion 502 unwound or spooled out from second shaft section 612 will be approximately equal.

To control how much lace is wound around the shaft, a position sensing assembly may be included with the tensioning system. Referring to FIGS. 5 and 10-13, tensioning system 300 is shown as having a position sensing assembly. In some embodiments, the position sensing assembly may include a shaft. For example, the position sensing assembly may include third shaft section 614. The shaft of the position sensing assembly may be configured to rotate about the same rotational axis as the rest of shaft 312. In some embodiments, the shaft may be integral with the rest of shaft 312. In other embodiments, the shaft may be a separate part connected to shaft 312 and/or first end flange 320. In some embodiments, the shaft of the position sensing assembly may be a lead screw. For example, the position sensing assembly shown in FIGS. 5-13 includes lead screw 605.

In some embodiments, the position sensing assembly may include an indicator tab. For example, the position sensing assembly may include indicator tab 510. In some embodiments, the position sensing assembly may include an optical sensing unit 520.

In some embodiments, indicator tab 510 may have a passage 1300 configured to receive lead screw 605. Passage 1300 may further include interior threads that may engage with threads of lead screw 605. The exterior of indicator tab 510 may have any geometric shape allowing first optical sensor 540 and second optical sensor 550 to detect indicator tab 510 in the manner described below. For example, in some embodiments, as shown in FIGS. 5 and 10-13, the exterior of indicator tab 510 may have a rectangular shape. In another example, in other embodiments, the exterior of the indicator tab may have an arcuate shape, a triangular shape, or a square shape.

Figure 13:
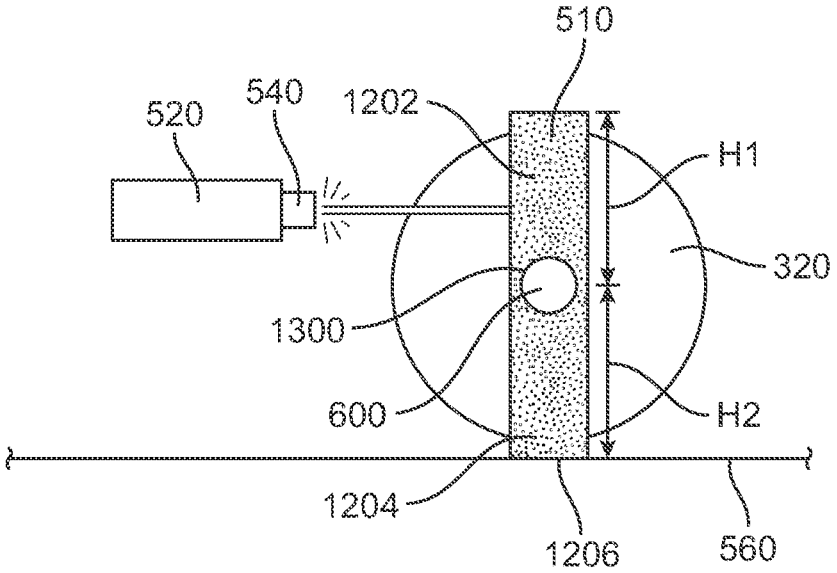
FIG. 13 is a side view of the position sensing assembly.

In some embodiments, indicator tab 510 may include a first portion 1302 that extends away from the portion of indicator tab 510 including passage 1300. As shown in FIG. 13, first portion 1202 may have a height H1. Height H1 may be selected to extend beyond lead screw 605 a distance sufficient for optical sensing unit 520 to detect indicator tab 510 without interference from lead screw 605. The portion of indicator tab 510 detected by optical sensing unit 520 may be a detectable area. In some embodiments, the portion of indicator tab 510 that includes passage 1300 may be a first unit and first portion 1302 may be a second unit attached to the first unit. For example, in some embodiments, the portion of the indicator tab that includes a passage may be a nut and the first portion of the indicator tab may be a flag, tab, or other object extending from the nut. In some embodiments, the indicator tab may be a nut.

Indicator tab 510 may include a second portion 1204 that extends away from the portion of indicator tab 510 including threaded passage 1300. As shown in FIG. 13, second portion 1204 may have a height H2. For reasons discussed in more detail below, height H2 may be selected to extend beyond lead screw 605 a distance sufficient for a surface 1206 of indicator tab 510 to contact bottom surface 560 of housing unit 304.

In some embodiments, second portion 1204 may be both the detectable area and the portion contacting a surface of housing unit 304. In other words, optical sensing unit 520 may be positioned to detect second portion 1204 instead of first portion 1202. For example, optical sensing unit may be positioned closer to surface 560 than where optical sensing unit 520 is shown in FIG. 13. In a more specific example, optical sensing unit may contact surface 560. In embodiments in which second portion 1204 is the detectable area, height H1 may be selected to extend less than a distance sufficient for optical sensing unit 520 to detect indicator tab 510 without interference from lead screw 605. Additionally, in such embodiments, height H2 may be selected to extend beyond lead screw 605 a distance sufficient for optical sensing unit 520 to detect indicator tab 510 without interference from lead screw 605.

Figure 10:
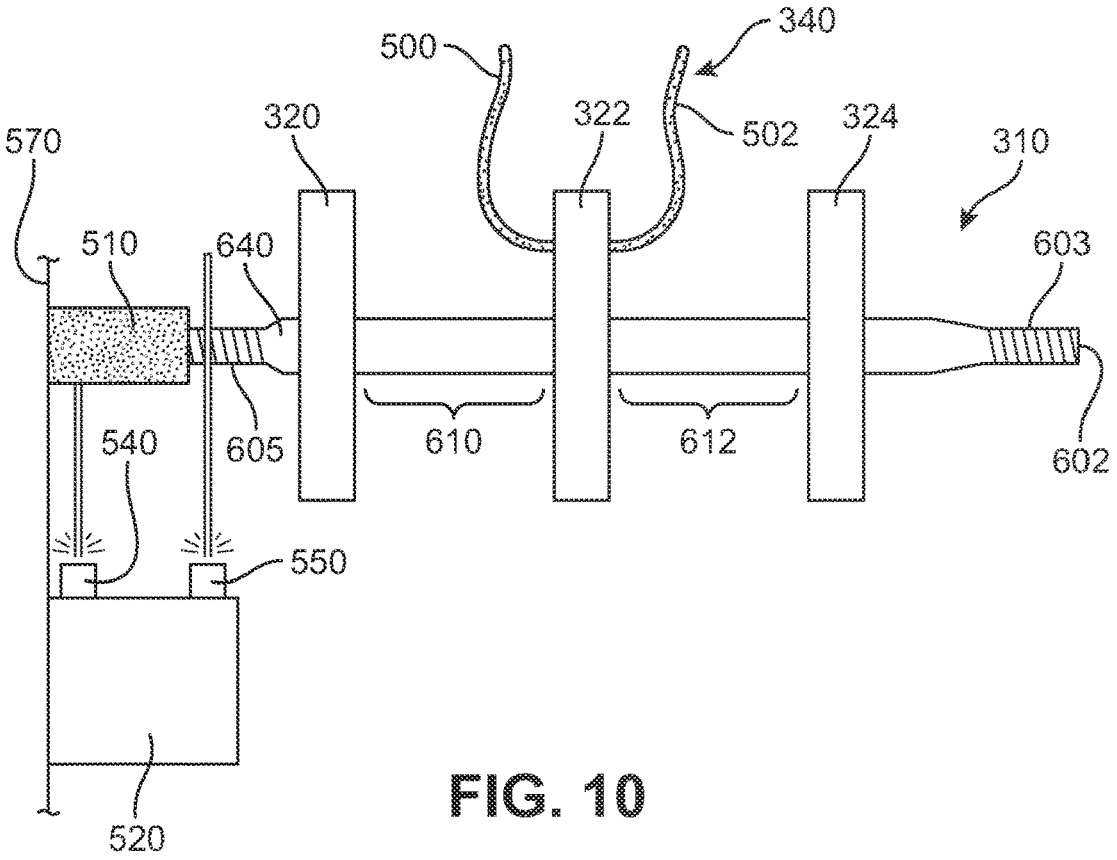
FIG. 10 is a top view of the position sensing assembly with the indicator tab in a first position.
Figure 11:
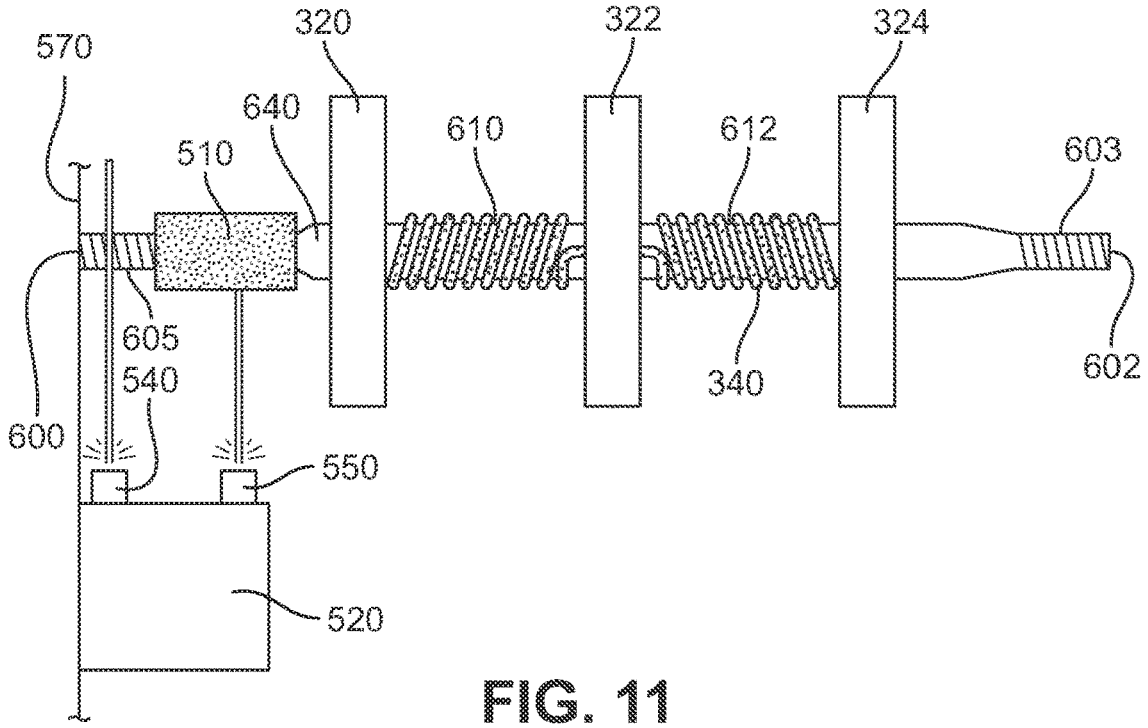
FIG. 11 is a top view of the position sensing assembly with the indicator tab in a second position.
Figure 12:
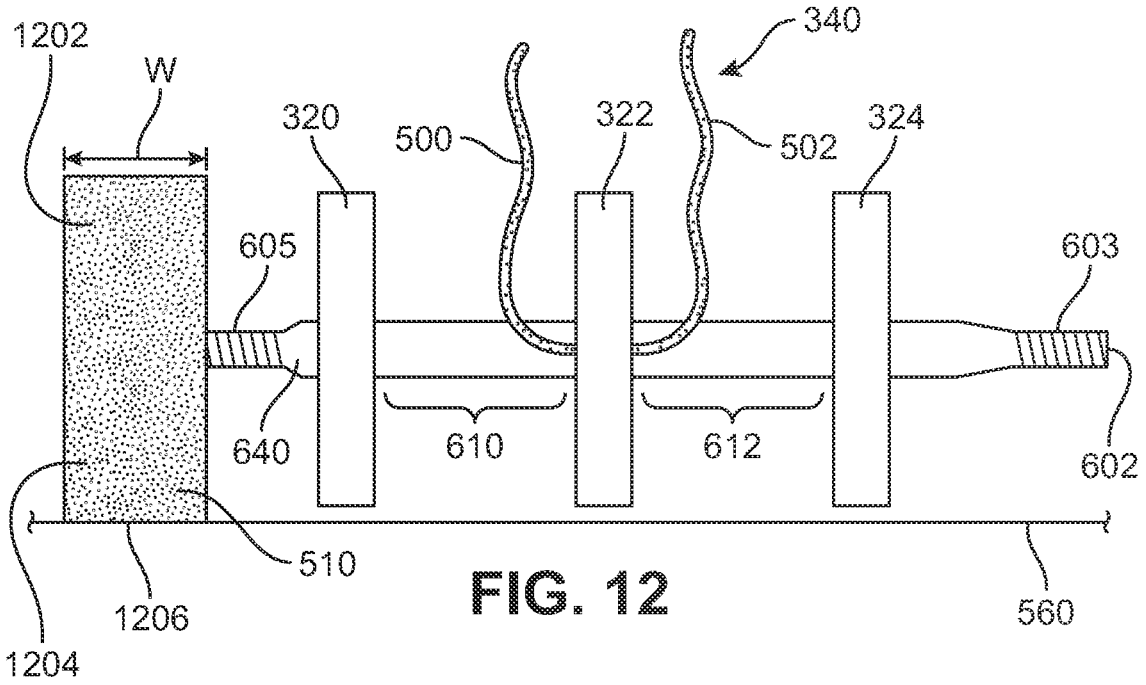
FIG. 12 is a front view of the position sensing assembly with the indicator tab in a first position.

Optical sensing unit 520 may be any sort of optical sensing unit capable of detecting the presence of an object in two different positions, and distinguishing between when the object is in the first position and when the object is in the second position. For example, optical sensing unit 520 may include a first optical sensor 540 capable of detecting the first position (FIG. 10) and a second optical sensor 550 capable of detecting the second position (FIG. 11). First optical sensor 540 and second optical sensor 550 may be capable of detecting the presence of an object. More specifically, first optical sensor 540 and second optical sensor 550 may be capable of detecting the presence of indicator tab 510. In some embodiments, first optical sensor 540 may be positioned and oriented such that first optical sensor may detect the presence of indicator tab 510 in the first position. For example, as shown in FIG. 13, first optical sensor 540 may be vertically aligned with the indicator tab 510 such that first optical sensor 540 can detect the detectable area of indicator tab 510 when indicator tab 510 is in the first position. In some embodiments, second optical sensor 550 may be positioned and oriented such that second optical sensor 550 may detect the presence of indicator tab 510 in the second position. For example, second optical sensor 550 may be vertically aligned with the indicator tab 510 such that second optical sensor 550 can detect the detectable area of indicator tab 510 when indicator tab 510 is in the first position. In some embodiments, as shown in FIGS. 10-11, first optical sensor 540 may be disposed on the same face of optical sensing unit 520 on which second optical sensor 550 is disposed. In such an arrangement, first optical sensor 540 and second optical sensor 550 may be disposed side-by-side. For example, in some embodiments, first optical sensor 540 may be vertically aligned with second optical sensor 550. The spacing between first optical sensor 540 and second optical sensor 550 is discussed below along with the operation optical sensing unit 520. Optical sensing unit 520 may be configured to distinguish between when the object is in the first position and when the object is in the second position. For example, optical sensing unit 520 may be connected with a processor programmed to distinguish between when the object is in the first position and when the object is in the second position.

An exemplary embodiment of the operation of the position sensing assembly is now described. Because third shaft section 614 may rotate about the same rotational axis as the rest of shaft 312, third shaft section 614 may rotate the same number of times shaft 312 rotates. Accordingly, the rotation of third shaft section 614 corresponds with the rotation of shaft 312. As third shaft section 614 rotates, contact between a surface 560 of housing unit 304 and bottom surface 1206 of indicator tab 510 may prevent indicator tab 510 from rotating along with shaft 312. When third shaft section 614 rotates, the threaded engagement between indicator tab 510 and screw 605, along with the contact between a surface 560 of housing unit 304 and bottom surface 1206 of indicator tab 510, causes indicator tab 510 to travel linearly along screw 605 in both a first linear direction and a second linear direction that is opposite the first linear direction. The first linear direction may be directed away from both center flange 322 and first end flange 320. The second linear direction may be directed toward both center flange 322 and first end flange 320. Indicator tab 510 may travel linearly along screw 605 between a first position (FIG. 10) and a second position (FIG. 11). Indicator tab 510 may travel linearly along screw 605 in the first linear direction to the first position (FIG. 10). Indicator tab 510 travel linearly along screw 605 in the second linear direction toward the second position (FIG. 11).

FIG. 10 shows indicator tab 510 in the first position. In the first position, indicator tab 510 is positioned as far as indicator tab 510 may go in the first linear direction. In some embodiments, a surface 570 of housing unit 304 may prevent indicator tab 510 from moving further in the first linear direction past end 600 of shaft 312.

FIG. 11 shows indicator tab 510 in the second position. In the second position, indicator tab 510 is positioned as far as indicator tab 510 may go in the second linear direction. In some embodiments, the lack of threads and/or the presence of a larger diameter at bulged region 640 may prevent indicator tab 510 from moving further in the second linear direction. While the exemplary embodiment shows bulged region 640 of third shaft section 614, it is understood that a nut or other object may be disposed where bulged region is located to prevent indicator tab 510 from moving further in the second linear direction. In some embodiments, bulged region 640 may be eliminated and first end flange 320 may prevent indicator tab 510 from moving further in the second linear direction.

The diameter of third shaft section 614, the length of third shaft section, and/or the threading (e.g., the angle of threads, pitch of threads, and/or number of threads per unit of distance) may be selected to correspond with the loosened and tightened condition of tensioning system 300. Accordingly, in some embodiments, as shown in FIG. 10, the first position of indicator tab 510 may correspond with the fully loosened condition of tensioning system 300 shown in FIG. 8. Additionally, in some embodiments, as shown in FIG. 11, the second position of indicator tab 510 may correspond with the fully tightened condition of tensioning system 300 shown in FIG. 9. Thus, the position of indicator tab 510 along screw 605 may indicate the relative tension of lace 340. While FIGS. 10 and 11 show the most extreme positions of indicator tab 510, it is understood that indicator tab 510 may have positions between the first position and the second position that indicate different degrees of tension of the tensioning system 300.

FIGS. 10-13 show the operation of optical sensing unit 520, including how optical sensing unit 520 detects the position of an indicator tab 510 disposed on lead screw 605. When indicator tab 510 is disposed in the first position, first optical sensor 540 may detect the presence of indicator tab 510, and second optical sensor 550 may not detect the presence of indicator tab 510. In other words, the condition of first optical sensor 540 detecting the presence of indicator tab 510 and second optical sensor 550 detecting the absence of indicator tab 510 may indicate that indicator tab 510 is in the first position and tensioning system 300 is in the loosened condition.

In some embodiments, when indicator tab 510 is disposed in the second position, first optical sensor 540 may not detect the presence of indicator tab 510, and second optical sensor 550 may detect the presence of indicator tab 510. In other words, the condition of first optical sensor 540 detecting the absence of indicator tab 510, and second optical sensor 550 detecting the presence of indicator tab 510, may indicate that indicator tab 510 is in the second position and tensioning system 300 is in the tightened condition. In some embodiments, a width W of indicator tab 510 and/or the distance between first optical sensor 540 and second optical sensor 550 may be selected to cause the above-mentioned detection of the first position and the second position. In some embodiments, width W of indicator tab 510 and/or the distance between first optical sensor 540 and second optical sensor 550 may be selected to cause first optical sensor 540 and second optical sensor 550 to be incapable of detecting the presence of indicator tab 510 at the same time. In some embodiments, first optical sensor 540 may be positioned or directed, with respect to indicator tab 510, such that indicator tab 510 is out of the line of sight of first optical sensor 540 when indicator tab 510 is in the second position. In some embodiments, second optical sensor 550 may be positioned or directed, with respect to indicator tab 510, such that indicator tab 510 is out of the line of sight of second optical sensor 550 when indicator tab 510 is in the first position.

In other embodiments, width W of indicator tab 510 and/or the distance between first optical sensor 540 and second optical sensor 550 may be selected to cause first optical sensor 540 and second optical sensor 550 to be capable of detecting the presence of indicator tab 510 at the same time. In such an embodiment, the condition of first optical sensor 540 and second optical sensor 550 both detecting the presence of indicator tab 510 at the same time may indicate that indicator tab 510 is in a position that is located between the first position and the second position, and thus, tensioning system 300 is in a condition that is in between the tightened condition and the loosened condition. In some embodiments, first optical sensor 540 and second optical sensor 550 may each be pivoted to direct the respective sensor toward a particular direction.

By sensing the first position of indicator tab 510, position sensing assembly may detect a condition that indicates when a lace is, and is not, wrapped about the shaft. Detecting this condition may assist in determining when rotation of shaft 312 should cease. Stopping shaft 312 from rotating when shaft 312 is absent of any lace may prevent lace 340 from beginning to wind around shaft 312 in a rotational direction that is opposite the rotational direction in which lace 340 was previously wound. Halting rotation of shaft 312 when shaft 312 is absent of any lace may leave the lace is the loosest condition. In other words, less lace on shaft 312 means more lace positioned between medial edge 134 and lateral edge 133 of upper 120. As a result, medial edge 134 and lateral edge 133 may be spaced further apart as lace 340 is removed from shaft 312. The more lace that is on the shaft 312, the less the percentage of lace 340 that is positioned between medial edge 134 and the lateral edge 133. As a result, medial edge 134 and lateral edge 133 may be closer together as lace 340 is wound around shaft 312. In one embodiment, discussed in more detail above, lace 340 may be configured to move plurality of strap members 136 of lacing system 130 so as to bring opposite lateral edge 133 and medial edge 134 of lacing area 132 closer together to tighten upper 120.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. An article of footwear, comprising:

an upper;

a sole structure attached to the upper; and a tensioning system disposed within one of the upper and the sole structure, the tensioning system including:

a reel member configured to rotate about a central axis;

an indicator tab mounted with respect to the reel member such that the indicator tab is moveable linearly from a first position to a second position as the reel member rotates about the central axis; and an optical sensing unit disposed adjacent the indicator tab and configured to detect a position of the indicator tab at one of the first position and the second position via a direct line of sight to the indicator tab;

wherein the reel member is configured to tighten the tensioning system by winding a lace around the shaft based, at least in part, on the position of the indicator tab as detected by the optical sensing unit.

2. The article of footwear according to claim 1, wherein the optical sensing unit comprises:

a first optical sensor positioned to detect the indicator tab in the first position; and a second optical sensor positioned to detect the indicator tab in the second position.

3. The article of footwear according to claim 2, wherein the first optical sensor is positioned to not detect the indicator tab in the second position.

4. The article of footwear according to claim 3, wherein the second optical sensor is positioned to not detect the indicator tab in the first position.

5. The article of footwear according to claim 4, wherein the indicator tab comprises:

a passage extending through the indicator tab;

a first portion extending away from the passage and positioned to be detected by the first optical sensor when the indicator tab is in the first position and by the second optical detector when the indicator tab is in the second position.

6. The article of footwear according to claim 5, wherein the indicator tab includes a second portion extending away from the passage in a direction opposite the first portion.

7. The article of footwear according to claim 6, wherein the second portion contacts a surface of a housing unit such that the surface inhibits the indicator tab from rotating in conjunction with rotation of the reel member.

8. The article of footwear according to claim 7, wherein the first optical sensor is positioned such that the first optical sensor can detect the second portion when the indicator tab is in the first position.

9. The article of footwear according claim 1, wherein the first position indicates that the tensioning system is in a loosened condition and the second position indicates that the tensioning system is in a tightened condition.

10. The article of footwear according to claim 1, wherein the optical sensing unit comprises a first optical sensor positioned to detect the indicator tab in the first position.

11. The article of footwear according to claim 10, wherein the optical sensing unit comprises a second optical sensor positioned to detect the indicator tab in the second position.

12. A method of making an article of footwear, comprising:

attaching a sole structure to an upper;

making a tensioning system by:

configuring a reel member to rotate about a central axis;

mounting an indicator tab mounted with respect to the reel member such that the indicator tab is moveable linearly from a first position to a second position as the reel member rotates about the central axis; and disposing an optical sensing unit adjacent the indicator tab and configured to detect a position of the indicator tab at one of the first position and the second position via a direct line of sight to the indicator tab;

wherein the reel member is configured to tighten the tensioning system by winding a lace around the shaft based, at least in part, on the position of the indicator tab as detected by the optical sensing unit; and disposing the tensioning system within the one of the upper and the sole structure.

13. The method according to claim 12, wherein disposing the optical sensing unit comprises:

positioning a first optical sensor to detect the indicator tab in the first position; and positioning a second optical sensor to detect the indicator tab in the second position.

14. The method according to claim 13, wherein the first optical sensor is positioned to not detect the indicator tab in the second position.

15. The method according to claim 14, wherein the second optical sensor is positioned to not detect the indicator tab in the first position.

16. The method according to claim 15, wherein the indicator tab comprises:

a passage extending through the indicator tab;

a first portion extending away from the passage and positioned to be detected by the first optical sensor when the indicator tab is in the first position and by the second optical detector when the indicator tab is in the second position.

17. The method according to claim 16, wherein the indicator tab includes a second portion extending away from the passage in a direction opposite the first portion.

18. The method according to claim 17, wherein the second portion contacts a surface of a housing unit such that the surface inhibits the indicator tab from rotating in conjunction with rotation of the reel member.

19. The method according to claim 18, wherein the first optical sensor is positioned such that the first optical sensor can detect the second portion when the indicator tab is in the first position.

20. The method according claim 12, wherein the first position indicates that the tensioning system is in a loosened condition and the second position indicates that the tensioning system is in a tightened condition.

* * * * *